United States Patent [19]

Edwards et al.

[11] Patent Number: 4,836,892

[45] Date of Patent: Jun. 6, 1989

[54] PULP BLENDS FOR LINERBOARDS

[75] Inventors: Anne M. Edwards, Wrightstown; Allen Rosen, Lawrenceville, both of N.J.

[73] Assignee: Union Camp Corporation, Wayne, N.J.

[21] Appl. No.: 917,391

[22] Filed: Oct. 9, 1986

[51] Int. Cl.[4] ..... D21H 5/12

[52] U.S. Cl. ..... 162/141; 162/142; 162/206; 162/207

[58] Field of Search ..... 162/141, 142, 206, 207

[56] References Cited

U.S. PATENT DOCUMENTS

| | | | |
|---|---|---|---|
| 3,319,352 | 5/1967 | Haigh | 162/206 |
| 3,354,035 | 11/1967 | Gottwald et al. | 162/206 |
| 3,873,412 | 3/1975 | Charters et al. | 162/142 |
| 4,145,246 | 3/1979 | Goheen et al. | 162/142 |
| 4,391,670 | 7/1983 | Phillips | 162/206 |

OTHER PUBLICATIONS

Anderson et al, "The Effect of Single Nip Press Drying on Properties of Liner of High Yield Kraft Pulp", *Pulp and Canada,* vol. 77, No. 12, pp. 82, 85–87.

Back et al, "Multistage Press Drying of Paper", Reprint from *Svensk Papperstidning,* No. 2–1979 82 (1979) pp. 35–39.

*Primary Examiner*—Peter Chin

[57] ABSTRACT

A process for preparing linerboards from blends of Kraft chemical pulp with a Kraft high yield pulp comprises forming the pulp blend into sheets, pressing the sheets to a specific solids content and subsequently pressing at a press impulse of at least 7.5 psig-second. The linerboards have the same crush strength as those prepared from Kraft chemical pulps.

7 Claims, No Drawings

PULP BLENDS FOR LINERBOARDS

BACKGROUND OF THE INVENTION

1. Field of the Invention

The invention pertains to manufacture of linerboard for corrugated boxes. More particularly the invention relates to a process wherein high yield cellulosic pulp may be substituted for a portion of more expensive conventional Kraft chemical pulp to manufacture linerboard for corrugated boxes.

2. Brief Description of the Prior Art The prior art literature is replete with descriptions of the preparation of paper forming pulps from lignocellulosic materials such as wood chips. The art itself is one of the most ancient. In spite of the antiquity of the art, new discoveries the objectives have been to advance the art in respect to greater economy; i.e., reducing costs by extending the pulp yield of the wood chips used in the pulping process, thereby reducing wood procurement costs and increasing recovery boiler capacity.

One of the problems associated with the use of high yield softwood fiber pulp in the manufacturing of linerboard has been the weakness of the product sheets. The final strength properties of linerboard formed from these high yield pulps are unacceptable in the marketplace. Replacement of the more expensive chemical pulp with high yield pulp substitutes has heretofore been limited to about 15% by weight, in the manufacture of linerboard. This results from the fact that as the percent of high yield pulp substitutes increased, the crush strength of the linerboard product decreased.

This invention allows for the manufacture of linerboard by substitution of a chemical pulp with up to 40% by weight of a high yield chemically treated softwood pulp, while still maintaining substantially the same crush strength as a linerboard sheet made from an all pine wood chemical pulp.

SUMMARY OF THE INVENTION

The invention comprises a method of preparing linerboard sheets for corrugated boxes, which comprises;

(A) providing a pulp furnish which comprises
  (i) from about 1 to about 40 percent by weight of a chemically treated, high yield softwood pulp; and
  (ii) from about 60 to about 99 percent by weight of a chemical pulp;
  said furnish having a Canadian Standard Freeness of from about 150 to about 700;

(B) forming a wet web from the furnish;

(C) pressing the wet web to a solids content within the range of from about 30 to about 40 percent;

(D) further pressing the wet web at a press impulse of at least 7.5 psi-second, at a web temperature greater than 100° F.

The term "chemical pulp" as used herein means a pulp prepared from wood chips via a conventional Kraft or other chemical pulping process resulting in a yield of 60% or less.

DETAILED DESCRIPTION OF THE INVENTION

The linerboard composition of this invention is advantageously formed from a pulp furnish containing a quantity of chemically treated, high yield softwood pulp. In the process of this invention up to 40% by weight of the chemically treated high yield pulp is employed in admixture with a conventionally used chemical pulp of 40–60% yield.

The term "high yield" is used herein to mean a yield of at least about 60 percent; preferably above 70 percent. The yield of a pulp is generally taken to mean the oven-dry weight of the pulp formed by a pulping process divided by the oven-dry weight of the lignocellulose starting material, multiplied by 100. In the present invention, the high yield pulp employed should have a yield high enough to provide a significant cost savings in order to justify the expense of its use. Accordingly, the conditions for preparing the high yield pulp must be such that a substantial amount of lignin is not removed. Kraft pulping conditions used to produce a high yield pulp are well known. Other pulping processes such as soda, polysulfide, and sulfite may also produce acceptable quality high yield pulp. In general, a mild digestion process is carried out within a temperature range of from about 80° C. to about 180° C. and at a pressure range of from atmospheric to 110 psi. The digestion is continued until the desired yield is obtained. The time required to reach this yield will of ' course vary with the raw lignocellulosic material undergoing digestion.

Advantageously, a first defibration of the pulped lignocellulosic material is carried out using equipment suitable for chip defibering, preferably in the form of a disc refiner. This may be carried out at a temperature within the range from about 40° C. to about 100° C., preferably from about 80° C. to about 90° C., and at atmospheric pressures. Defibrators for use in this stage include not only disc refiners but also conical mills and screw defibrators. Disc refiners operating at a a superatmospheric pressure within the range from about 0.5 to about 10 n/m$^2$ may also be used.

The partially defibrated lignocellulosic material may then be screened. The screen rejects may be subjected to further defibering. The objective is to reduce the amount of fiber bundles and screen rejects to less than 25% by weight of the high yield pulp.

The defibered and screened pulp material may then be subjected to a chemical treatment. For this invention an alkaline peroxide process is preferred but a caustic, ozone, oxygen, sulfite, or oxidative extraction (EO) type of treatment process may also produce acceptable quality pulp. The treatment conditions should not result in a lowering of the pulp yield below the minimums described above. For the alkaline peroxide treatment process, 1% to 10% sodium hydroxide, and 0% to 1% magnesium sulfate based on the weight of lignocellulosic material is added to the defibered lignocellulosic pulp material. This chemical treatment may be advantageously carried out in the temperature range of 40° C. to about 100° C., preferably in the temperature range of 60° C. to 80° C. The treatment time may range from 5 minutes to 90 minutes once the lignocellulosic material reaches reaction temperature. The purpose of this treatment stage is to partially delignify, i.e.; break some of the lignin's chemical bonds in order to make the fiber more conformable while at the same time retaining the lignin fragments, thus maintaining the desired pulp yield.

After the post-treatment stage the lignocellulosic pulp is advantageously washed in order to remove residual chemicals. The pulp material may then be refined so as to further enhance fiber-to-fiber bonding. One way of measuring the degree of refining is to measure the pulp's drainage characteristics. A measure of this drainage parameter is freeness, and more particularly Canadian Standard Freeness (CSF). More ' particularly, for most commercial linerboard machines in operation today, Canadian Standard Freenesses typically range from about 150 CSF to 700 CSF. In general pine freenesses preferably range from about 550 CSF to 650 CSF and this is the preferred freeness range obtained by refining the chemically treated pulp used in this invention.

The refined, chemically treated, high yield pulp may be combined with a conventional chemical pulp described above by simple admixture. Alternatively, the chemically treated high yield pulp may be combined first with a chemical pulp and the mixture of pulps refined together. The mixture of refined pulp may then be wet formed into a commercial-grade linerboard web. After forming, the wet web is pressed to raise the solids content, preferably to about 33% exiting solids but within the range of 30% to 40% exiting solids. The pressed web is then subjected to an additional pressing operation at a press impulse of at least 7.5 psi-second (advantageously up to about 30 psi-second) at a temperature above 100° F. (preferably below about 200° F.) in order to develop the crush resistance of the sheet. Although the inventor is not to be bound by any theory of operation, one possible explanation for the enhanced crush strength observed is that the chemical pulp serves to bond the stiff high yield pulp fibers together and thus the chemical pulp provides bond strength while the high yield pulp provides the stiffness needed for crush resistance.

The following example describes the manner and the process of making and using the invention and sets forth the best mode contemplated by the inventor of carrying out the invention but is not to be construed as limiting. All percentages given are by weight. Where reported, CSF was determined by the method of TAPPI T-227 Ring crush was determined by the method of TAPPI T-818, and the STFI crush factor by the method recommended by the Institute of Paper Chemistry, there currently being no standardized procedure for performing this test.

EXAMPLE

Quantities of lignocellulose, in the form of Southern pine chips, were pulped using the Kraft pulping process The pulping conditions were as follows:

27% sulfidity
15% active alkali ($Na_2O$ Basis)
4.25:1 liquor to wood ratio
2.5 minutes steaming at 15 psig
50 minutes heating from 80° C. to 165° C.

The pulp yield after the Kraft pulping stage was 73% based on the oven dried weight of the starting material.

The pulp was then subjected to a first defibration stage. The pulp was defibered at about 5% consistency and at about 80° C. using a disc refiner operating at atmospheric pressure. The pulp was then screened on a flat screen containing slots of 10/1000 inch. After the first defibering stage the pulp consisted of about 45% screen rejects. The screen rejects were then refined at about 10% consistency at 90° C. using a disc refiner operating at atmospheric pressure. When the refined rejects were combined with the screen accepts from the first defibering stage, the overall reject level was about 10%.

The defibered pulp was then post treated using the alkaline peroxide process. The reaction conditions were as follows:

0.5% hydrogen peroxide
3.0% sodium hydroxide
90 minute reaction time
95° C. reaction temperature
12% pulp consistency The pulp yield after the post treatment was about 71% based on the oven dried weight of the Southern pine chips. After the post treatment stage the wood pulp was washed in order to remove remaining post treatment chemicals.

In this example, a mixture of the peroxide post treated high yield pulp and a chemical linerboard pulp were combined to form a composite furnish. The chemical linerboard pulp used in this example was produced using the Kraft process. The pulping conditions used to produce this pulp were as follows:

27% sulfidity
15% active alkali ($Na_2O$ Basis)
3.75:1 liquor to wood ratio
2.5 minutes steaming at 15 psig
60 minutes heating from about 80° C. to 173° C.
30 minutes at 173° C.

Slash pine wood chips were used to produce this chemical pulp and the pulp yield after the Kraft pulping stage was about 56% based on the oven dried weight of the starting material. This pulp had a kappa number of about 75.

The chemical pulp was then defibered using a disc refiner operating at about 80° C. and at atmospheric pressure The pulp was defibered at about 5% consistency.

Both the chemical pulp and the high yield pulp described above were refined to various freeness levels commonly used for producing linerboard. Each pulp was beaten separately and then aliquots of the beaten pulps were combined so that the resulting furnish contained 30% by weight beaten high yield pulp and 70% by weight beaten chemical pulp. The component pulps of this pulp mixture were both at about the same freeness. Handsheets were then made from the chemical pulp, the high yield pulp, and the 70/30 blend. These sheets had a basis weight of roughly 38 lbs. O.D. per 1000 square feet.

The damp sheets were sandwiched between dry blotters and pressed to about 33% solids. The damp blotters were then removed and the sheet was then quickly heated to about 140° F on a hot plate. Once the sheet reached temperature, it was quickly removed from the hot plate and pressed on a pilot extended nip press. The press operated at 2000 fpm at loadings of 3000 pli and 6000 pli. The sheets were then completely dried using a drum drier.

The sheets were subjected to testing to determine their crush properties. The results for the chemical pulp, the high yield pulp, and the 70/30 blend are shown below in Tables 1A, 1B, and 1C, respectively.

TABLE 1A

| | | | | | | |
|---|---|---|---|---|---|---|
| % Chemical Pulp | 100 | 100 | 100 | 100 | 100 | 100 |
| % High Yield Pulp | 0 | 0 | 0 | 0 | 0 | 0 |
| Freeness (CSF) | 662 | 662 | 604 | 604 | 499 | 499 |
| Press Load | 3000 | 6000 | 3000 | 6000 | 3000 | 6000 |
| Ring Crush Factor (Km) | 1.57 | 1.52 | 1.52 | 1.69 | 1.76 | 1.94 |
| STFI Crush Factor (Km) | 2.96 | 3.30 | 3.08 | 3.37 | 2.99 | 3.35 |

TABLE 1B

| | | | | | | |
|---|---|---|---|---|---|---|
| % Chemical Pulp | 0 | 0 | 0 | 0 | 0 | 0 |
| % High Yield Pulp | 100 | 100 | 100 | 100 | 100 | 100 |

TABLE 1B-continued

| | | | | | | |
|---|---|---|---|---|---|---|
| Freeness (CSF) | 663 | 663 | 593 | 593 | 487 | 487 |
| Press Load | 3000 | 6000 | 3000 | 6000 | 3000 | 6000 |
| Ring Crush Factor (Km) | 1.32 | 1.33 | 1.35 | 1.82 | 1.93 | 1.75 |
| STFI Crush Factor (Km) | 2.62 | 2.44 | 2.64 | 3.20 | 3.26 | 2.92 |

TABLE 1C

| | | | | | | |
|---|---|---|---|---|---|---|
| % Chemical Pulp | 70 | 70 | 70 | 70 | 70 | 70 |
| % High Yield Pulp | 30 | 30 | 30 | 30 | 30 | 30 |
| Freeness (CSF) | 648 | 648 | 600 | 600 | 474 | 474 |
| Press Load | 3000 | 6000 | 3000 | 6000 | 3000 | 6000 |
| Ring Crush Factor (Km) | 1.69 | 1.73 | 1.81 | 1.84 | 1.91 | 2.15 |
| STFI Crush Factor (Km) | 3.16 | 3.74 | 3.28 | 3.49 | 3.78 | 3.64 |

From the data in the above tables it will be seen that the crush of the high yield pulp sheets is generally less than that of the chemical pulp formed sheets. However the crush strength of sheets made from the blend is either equal to or greater than that of the chemical pulp sheets in all cases.

What is claimed is:

1. A method of preparing linerboard sheets which comprises;

(A) providing a pulp furnish which comprises (i) from about 1 to about 40 percent by weight of a alkaline peroxide, high yield softwood pulp; and (ii) from about 60 to about 99 percent by weight of a chemical pulp;

said furnish having a Canadian Standard Freeness of from about 150 to about 700;

(B) forming a wet web from the furnish;

(C) pressing the wet web to a solids content within the range of from about 30 to about 40 percent;

(D) further pressing the wet web at a press impulse of at least 7.5 psi-second, at a web temperature greater than 100° F.

2. The method of claim 1 wherein the high yield pulp has a yield of at least 60 percent.

3. The method of claim 1 wherein the chemical pulp has yield of about 40 to 60 percent.

4. The method of claim 1 wherein the furnish comprises about 70 percent by weight of chemical pulp and about 30 percent by weight of high yield pulp.

5. The method of claim 1 wherein the Freeness is within the range of from about 500 to about 650.

6. The method of claim 1 wherein the web is pressed at a temperature of about 140° F.

7. The method of claim 1 wherein the press impulse is within the range of from about 7.5 to 30 psi-second.

* * * * *